US010661103B2

(12) United States Patent
Griffiths et al.

(10) Patent No.: US 10,661,103 B2
(45) Date of Patent: May 26, 2020

(54) SELF-BRAKING PULLEY

(71) Applicant: SWISSLOGO AG, Zurich (CH)

(72) Inventors: Stephen Griffiths, Waunfawr (GB); Dion Owen, Waunfawr (GB)

(73) Assignee: SWISSLOGO AG, Zurich (CH)

( * ) Notice: Subject to any disclaimer, the term of this patent is extended or adjusted under 35 U.S.C. 154(b) by 107 days.

(21) Appl. No.: 15/737,022

(22) PCT Filed: Jun. 15, 2016

(86) PCT No.: PCT/EP2016/063808
§ 371 (c)(1),
(2) Date: Dec. 15, 2017

(87) PCT Pub. No.: WO2016/202891
PCT Pub. Date: Dec. 22, 2016

(65) Prior Publication Data

US 2018/0169446 A1 Jun. 21, 2018

(30) Foreign Application Priority Data

Jun. 15, 2015 (GB) ..... 1510458.1

(51) Int. Cl.
*A62B 1/10* (2006.01)
*A62B 35/00* (2006.01)
*A62B 35/04* (2006.01)

(52) U.S. Cl.
CPC ..... *A62B 1/10* (2013.01); *A62B 35/0093* (2013.01); *A62B 35/04* (2013.01)

(58) Field of Classification Search
CPC ..... A62B 1/10; A62B 1/08; A62B 35/0093; A62B 35/04
See application file for complete search history.

(56) References Cited

U.S. PATENT DOCUMENTS 4,589,523 A * 5/1986 Olson ..... A62B 35/0093 182/234
4,591,029 A * 5/1986 Da Foe ..... B66D 1/06 188/134

(Continued)

FOREIGN PATENT DOCUMENTS

DE 894 354 C 10/1953
EP 2 845 626 A1 3/2015

(Continued)

OTHER PUBLICATIONS

PCT/EP20161063808 International Search Report and Written Opinion; dated Dec. 22, 2016; (11 pages).
GB 1510458.1 Search Report dated Dec. 18, 2015 (3 pages).

*Primary Examiner* — Michael E Gallion
(74) *Attorney, Agent, or Firm* — Polsinelli PC; Brian Diekhoff

(57) ABSTRACT

A self-braking pulley is disclosed for controlling a rate of extraction of a tether wound upon the pulley. The pulley includes a spool for receiving a tether, the spool being arranged to rotate about an axle of the pulley as the tether is removed therefrom. The pulley further includes a braking assembly for applying a braking force to the spool and a drive assembly which is engagable with the spool via an engagement member. The engagement member is arranged to rotationally couple the spool with the drive assembly for driving the braking assembly, in dependence of a rate of rotation of the spool about the axle.

14 Claims, 5 Drawing Sheets

(56) References Cited

U.S. PATENT DOCUMENTS

| | | | | | |
|---|---|---|---|---|---|
| 5,351,906 | A * | 10/1994 | Feathers | A62B 1/10 | 182/237 |
| 6,446,936 | B1 * | 9/2002 | Ostrobrod | A62B 35/0056 | 254/368 |
| 2005/0051659 | A1 * | 3/2005 | Wolner | A62B 1/10 | 242/383.5 |
| 2005/0247919 | A1 * | 11/2005 | Hoffend, Jr. | A63J 1/028 | 254/347 |
| 2010/0025157 | A1 * | 2/2010 | Casebolt | A62B 1/10 | 182/231 |
| 2010/0224448 | A1 * | 9/2010 | Wolner | A62B 1/10 | 182/234 |
| 2010/0226748 | A1 * | 9/2010 | Wolner | A62B 35/0093 | 414/815 |
| 2011/0147125 | A1 * | 6/2011 | Blomberg | H02K 49/043 | 182/232 |
| 2011/0278095 | A1 * | 11/2011 | Hetrich | A62B 1/10 | 182/231 |
| 2011/0315481 | A1 * | 12/2011 | Griffiths | A62B 1/08 | 182/231 |
| 2014/0048758 | A1 * | 2/2014 | Oland | E04H 17/266 | 254/217 |
| 2017/0361137 | A1 * | 12/2017 | Griffiths | A62B 1/12 | |
| 2019/0084813 | A1 * | 3/2019 | Farkash | B61H 9/02 | |

FOREIGN PATENT DOCUMENTS

| | | | | | |
|---|---|---|---|---|---|
| GB | 999522 | A | | 7/1965 | |
| GB | 2256414 | A | * | 12/1992 | A62B 1/10 |
| GB | 2306107 | A | * | 4/1997 | A62B 35/0093 |
| GB | 2548879 | A | * | 10/2017 | B65H 75/4442 |

* cited by examiner

SELF-BRAKING PULLEY

CROSS REFERENCE TO RELATED APPLICATION

This application is a US National Application of PCT Application No. PCT/EP2016/063808 filed on Jun. 15, 2016 which claims priority to GB Patent 1510458.1 filed Jun. 15, 2015.

FIELD OF INVENTION

The present invention relates to a self-braking pulley.

BACKGROUND

It is well known for individuals working or operating at height to use a tether to secure themselves to a suitable support to arrest their fall should they unexpectedly fall or otherwise need to escape from their position. The tether is typically secured to the individuals harness and as such, while the tether may arrest their fall, there can be a significant jolt upon the individual as the tether becomes taught. Moreover, once the individual has come to a rest and is held suspended from the tether it is necessary to lower the individual to avoid any trauma from prolonged suspension, particularly if the individual is unconscious and held in an inverted orientation.

SUMMARY

We have now devised a self-braking pulley.

In accordance with the present invention there is provided a self-braking pulley for controlling a rate of extraction of a tether coupled with the pulley, the pulley comprising a spool for receiving a tether, the spool being arranged to rotate about an axle of the pulley as the tether is removed therefrom, the pulley further comprising a braking assembly for applying a braking force to the spool, and a drive assembly which is engagable with the spool via an engagement member, the drive assembly being arranged to drive the braking assembly, wherein the engagement member is arranged to rotationally couple the spool with the drive assembly for driving the braking assembly, in dependence of a rate of rotation of the spool about the axle.

Advantageously, the braking assembly is arranged to limit the rate of rotation of the spool and thus the rate of descent of a user, thereby minimising any sudden jolts and prolonged periods where the user may otherwise be held suspended above a floor, for example.

In an embodiment, drive assembly comprises a wheel having a plurality of serrations disposed along an outer perimeter thereof, and a drive gear which is rotationally coupled with the wheel. The wheel and drive gear are preferably arranged to rotate about the axle.

In an embodiment, the engagement member comprises a pawl which is pivotally coupled to the spool about a pivot, proximate a peripheral region thereof. The pawl is arranged to pivot in a plane in which the wheel extends and comprises a centre of mass which is disposed to one side of the pivot, such that a proximate end of the pawl extends closer to the pivot than a distal end of the pawl. The pawl is reconfigurable between a neutral configuration in which the proximate end of the pawl extends away from the wheel, and a drive configuration in which the proximate end of the pawl abuts the serrations on the wheel.

In an embodiment, the pulley further comprises an elastic member which is coupled at one end to the spool and at the other end to the distal end of the pawl, for controlling the rotation of the pawl about the pivot. As the tether is unwound from the spool, the spool will rotate and the distal end of the pawl will begin to move in a radially outward direction of the spool owing to the increased mass of the pawl at the one side of the pivot. The elastic member is thus arranged to limit the rotation of the pawl about the pivot in dependence of the rotation of the spool.

In an embodiment, the braking assembly comprises a plurality of brake pads which are arranged to contact a brake drum in dependence of a rate of rotation of the spool about the pulley axle. The brake pads are separately disposed upon a respective shoe and each shoe is hingedly coupled to a shoe plate at angularly separated positions around a periphery of the plate. The shoes are hingedly coupled at one end thereof to the plate, such that the contact area of the brake pad with the brake drum varies in dependence of a rate of rotation of the plate. In an embodiment, the shoes are hingedly coupled to the shoe plate at the one end of the shoe which is the leading end during rotation of the plate. The trailing end of each shoe is coupled via an elastic member to the trailing end the shoe rotationally adjacent the one shoe. In this respect, the elastic member are arranged to limit the rotation of each shoe about the respective hinged coupling to control the area of the brake pad which is arranged to contact the drum, in dependence of a rate of rotation of the plate.

In an embodiment, the braking assembly comprises a follower gear which is rotationally coupled with the drive gear. Preferably, the follower gear and shoe plate are rotationally coupled with an axle of the braking assembly.

Preferably, the self-braking pulley further comprises a housing for housing the spool, drive assembly, engagement member and braking assembly. The pulley axle and the axle of the braking assembly are preferably supported by the housing.

In an embodiment, the pulley further comprises at least one tether guide for guiding the tether to and from the spool.

Whilst the invention has been described above, it extends to any inventive combination of features set out above or in the following description. Although illustrative embodiments of the invention are described in detail herein with reference to the accompanying drawings, it is to be understood that the invention is not limited to these precise embodiments.

Furthermore, it is contemplated that a particular feature described either individually or as part of an embodiment can be combined with other individually described features, or parts of other embodiments, even if the other features and embodiments make no mention of the particular feature. Thus, the invention extends to such specific combinations not already described.

The invention may be performed in various ways, and, by way of example only, embodiments thereof will now be described, reference being made to the accompanying drawings in which:

DETAILED DESCRIPTION OF INVENTION

Figure 1:
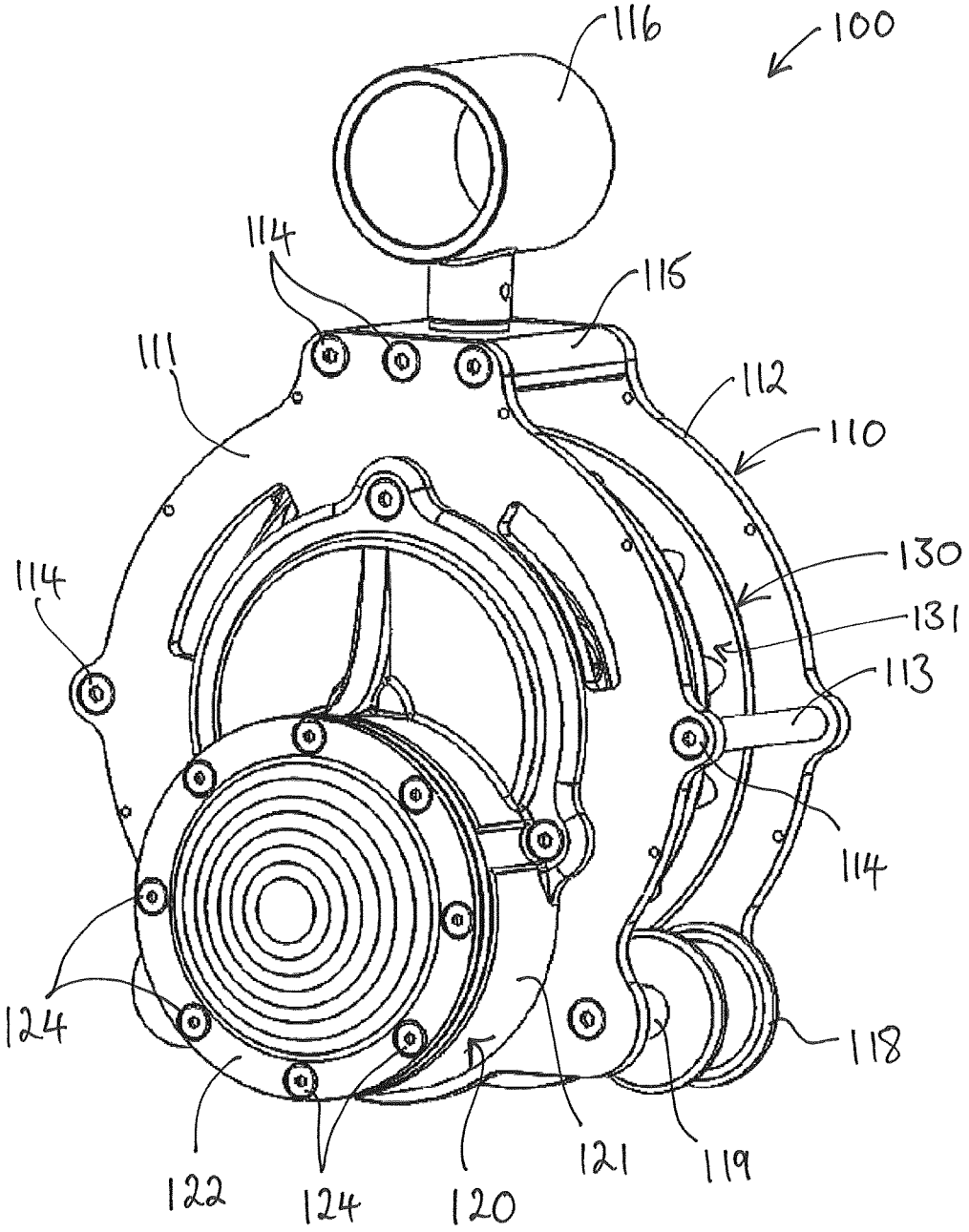
FIG. 1 is perspective view of a self-braking pulley according to an embodiment of the present invention.

Referring to FIG. 1 of the drawings, there is illustrated a self-braking pulley 100 according to an embodiment of the present invention, for controlling a rate of extraction of a tether (not shown) wound upon the pulley 100. It is envisaged that this pulley 100 may be used for rapid descent from a height, such as when escaping from a building or a platform (not shown), or equally for arresting a fall of a person working at height. The controlled rate of descent offered by the pulley 100 further minimises any trauma which may otherwise be created following a prolonged suspension within a harness, for example.

Figure 2:
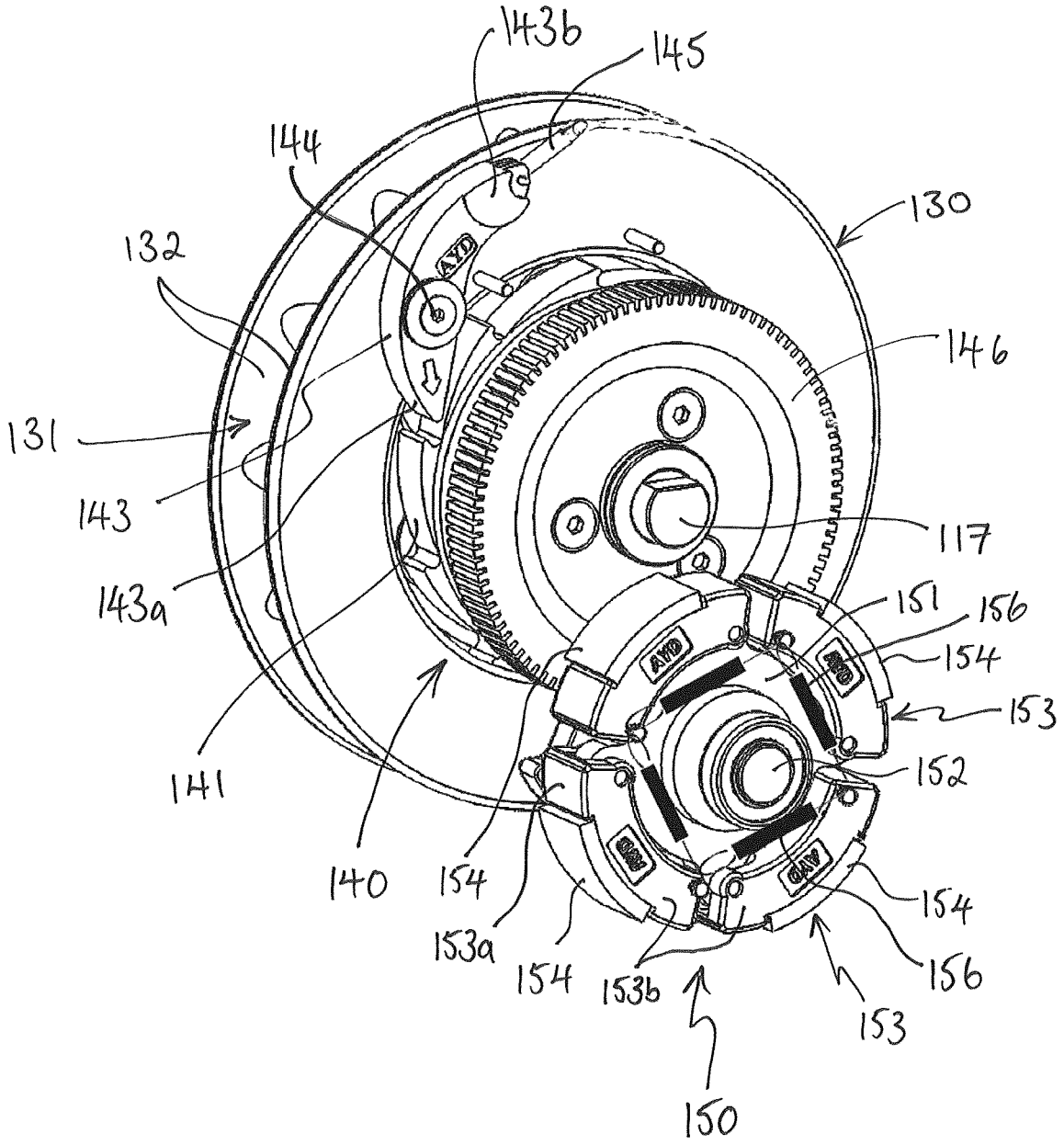
FIG. 2 is a perspective view of the spool, drive assembly and braking assembly.

Referring to FIGS. 1 and 2 of the drawings, the self-braking pulley 100 comprises a housing having a first housing portion 110 which is arranged to house a spool 130 and drive assembly 140, and a second housing portion 120 which is arranged to house a braking assembly 150. The first housing portion 110 comprises a front and rear wall 111, 112 which are held in spaced relation by struts 113 which extend between the walls 111, 112 and which are secured to the walls 111, 112 by fasteners 114, such as a screw and bolts. The struts 113 are separated along a periphery of the first and second wall 111, 112. At an upper region of the first housing portion 110 there is provided an anchor plate 115 which similarly extends between the front and rear wall 111, 112 thereof, and which is arranged to support an anchoring member 116, such as an eyelet, for enabling the pulley 100 to be secured to a suitable support (not shown).

Figure 5:
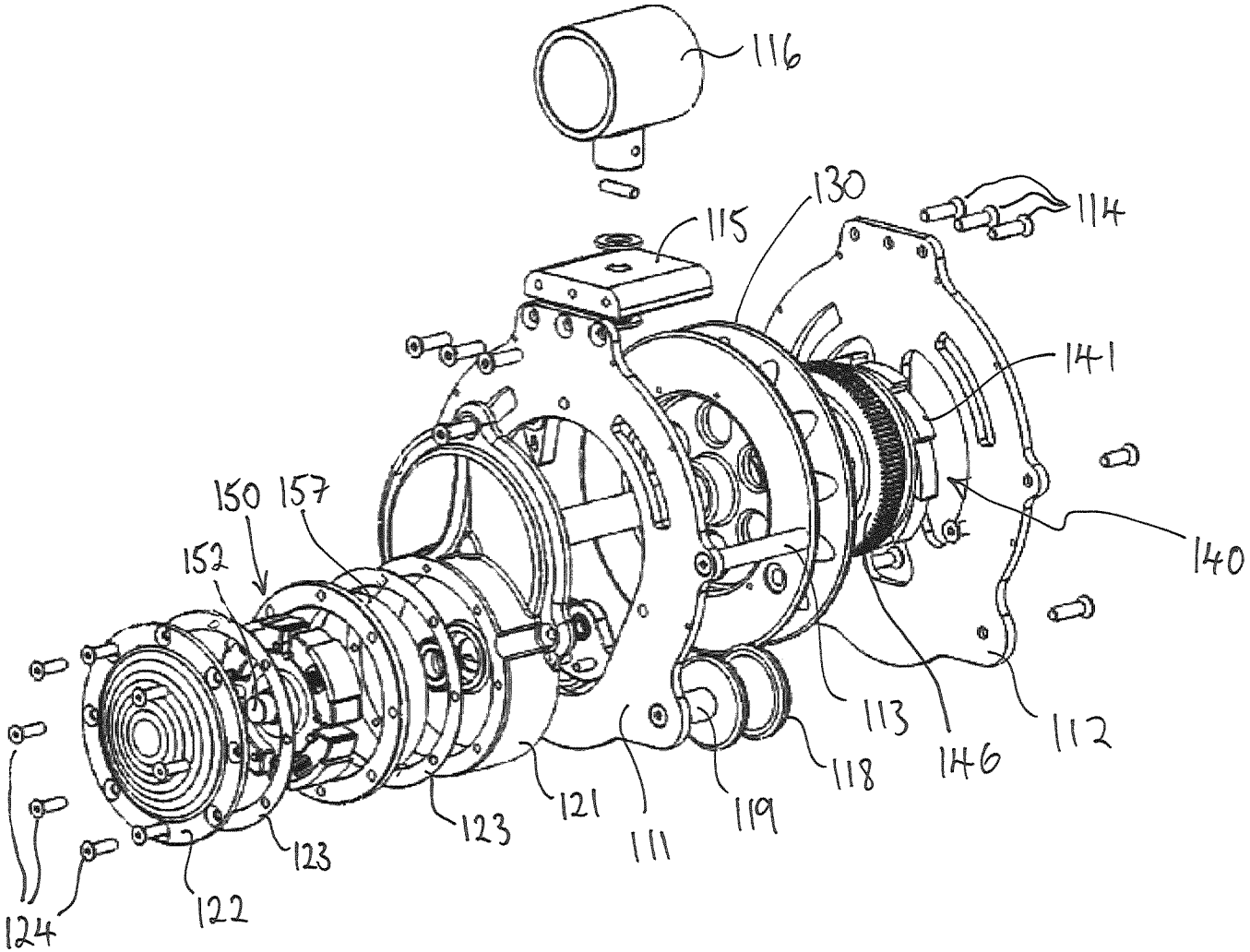
FIG. 5 is an exploded view of the pulley illustrated in FIG. 1.

The second housing portion 120 is disposed at a front of the first housing portion 110 and comprises a substantially cylindrical drum 121, which is closed at a rear thereof by the front wall 111 of the first housing portion 110, and at the front thereof by a drum cover 122. The second housing portion 120 may further comprise a gasket or seal 123 (as illustrated in FIG. 5 of the drawings) which is arranged to extend between the cover 122 and the drum 121 to minimise any debris from passing into the drum 121. In this respect, the drum 121 is secured to the front wall 111 of the first housing portion 110 and the cover is secured to the drum by a plurality of fasteners 124, such as screws and bolts.

The spool 130 disposed within the first housing portion 110 is arranged to rotate about an axle 117 which extends between the front and rear wall 111, 112 of the first housing portion 110. The spool 130 is arranged to receive a tether, such as a rope (not shown), which may be wound upon the spool 130 and rotationally coupled therewith, such as by rigidly coupling one end of the tether to the spool 130. The other end of the tether is arranged to extend out from the first housing portion 110, such as at a lower region thereof, and is preferably guided out from the housing 110 by a guide spool 118 which is arranged to rotate about a guide axle 119 that extends between the front and rear walls 111, 112, at the lower region thereof.

In an alternative embodiment, the spool 130 comprises a circumferentially extending groove 131 which extends radially inwardly of the spool. The groove 131 is defined by side walls 132 which converge in a direction which is radially inwardly of the spool 130 so that the tether becomes gripped by the spool 130 and thus rotationally coupled to the spool 130. In this embodiment, the tether may be simply arranged to pass over the spool 130 (as opposed to being wound completely around the spool) such that the free ends of the tether extend out from the pulley 100 at opposite sides of the spool 130, and guided by a respective guide spool 118 (only one of which is illustrated in the drawings) disposed at the lower region of the first housing portion 110.

Figure 3:
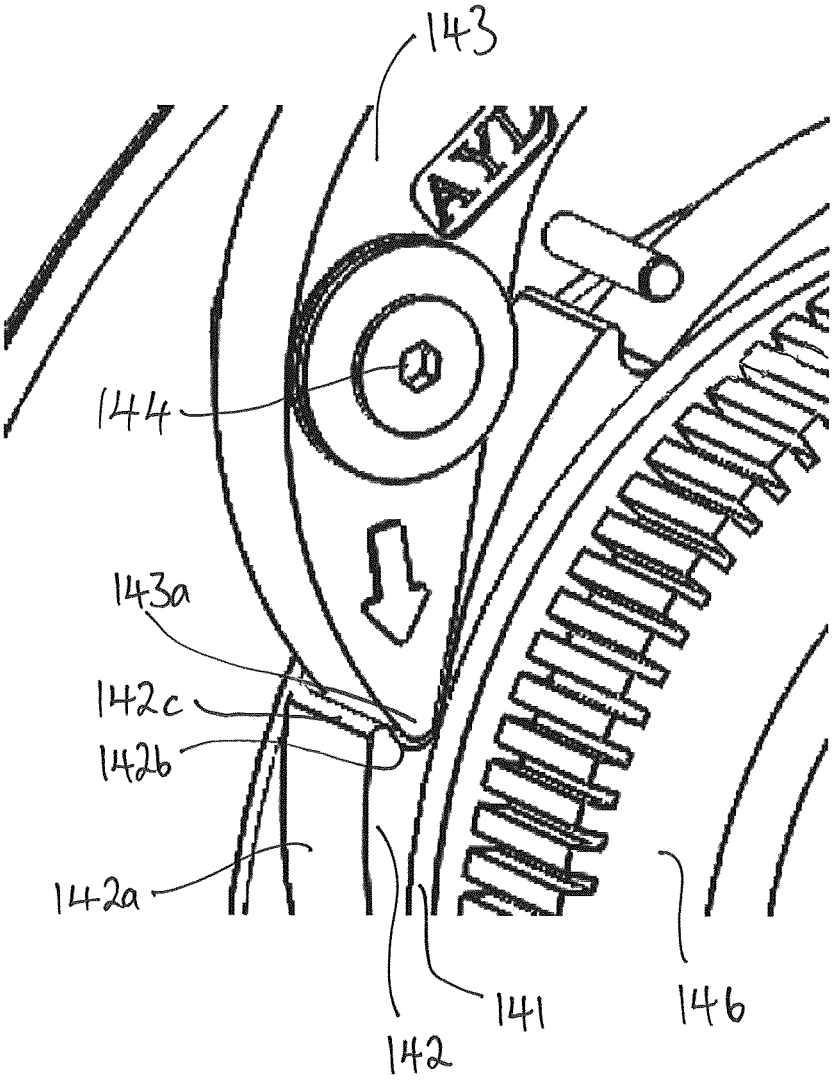
FIG. 3 is a magnified view of the pawl engaged with the wheel.

The drive assembly 140 comprises a wheel 141 which is arranged to rotate about the axle 117 and comprises a plurality of serrations 142 disposed along a periphery thereof. The serrations 142 are asymmetric and separately comprise a long face 142*a* and a short face 142*b* which meet at an apex 142*c*, such that short face 142*b* forms a larger angle with a tangent to the wheel 141 than the long face 142*a*. The drive assembly 140 further comprises a pawl 143 which is pivotally coupled to a side of the spool 130, such that the pawl 143 is arranged to pivot in a plane which comprises the wheel 141. The pawl 143 comprises proximal end 143*a* which is disposed closer to the pivot 144 than the distal end 143*b*, and as such the centre of mass of the pawl 143 is disposed toward the side of the pivot 144 which extends toward the distal end 143*b*. The pawl 143 is further coupled to the spool 130 by an elastic member 145, such as a spring, which is coupled at one end to the distal end 143*b* of the pawl 143 and at the other end to the side of the spool 130. The pawl 143 is arranged to couple with the wheel 141 in dependence of the rotational speed of the spool 130, and thus the pawl 143 and wheel 141 collectively form a ratchet, as illustrated in FIG. 3 of the drawings.

The drive assembly 140 further comprises a drive gear 146 disposed upon the axle 117, which is rotationally coupled with the wheel 141, such that the drive gear 146 rotates about the axle 117 in accordance with a rotation of the wheel 141.

Figure 4:
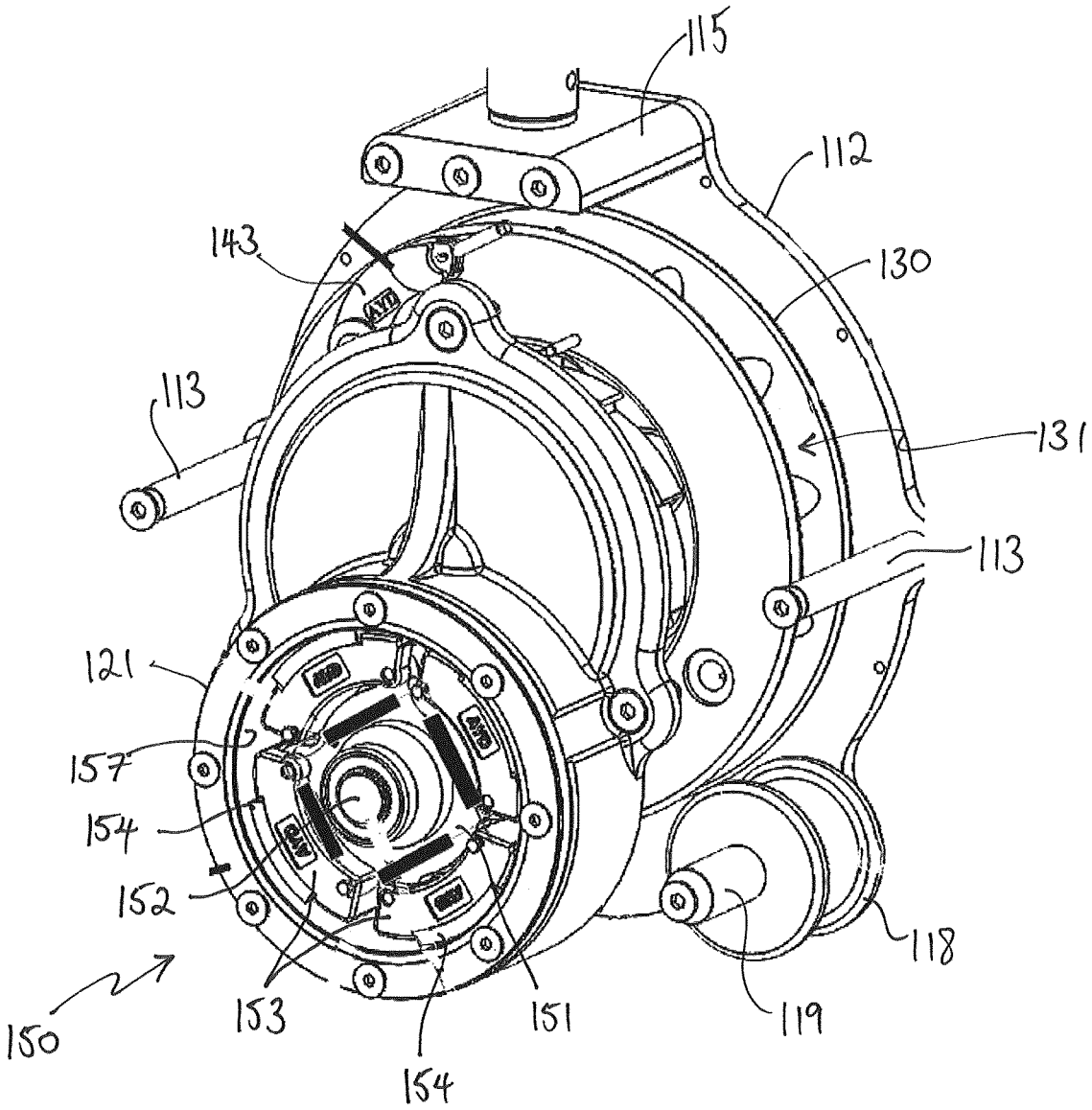
FIG. 4 is a perspective view of the pulley illustrated in FIG. 1, with the front wall of the first housing portion and the cover of the second housing portion, removed.

Referring to FIGS. 4 and 5 of the drawings, the braking assembly 150 of the pulley 100 comprises a shoe plate 151 which is arranged to rotate with an axle 152 that extends through the second housing portion 120. The axle 152 is supported in a bearing assembly (not shown) separately mounted within a cover 122 of the drum 121, a front wall 111 of the first housing portion 110 and the rear wall 112 of the first housing portion 110. The shoe plate 151 comprises a plurality of brake shoes 153 hingedly coupled thereto, along a periphery thereof. The brake shoes 153 are angularly separated around the plate 151 and are arranged to pivot about the respective hinge in a plane comprising the shoe plate 151. The brake shoes 153 separately comprise a bridging member 153*a* which extend over an outer perimeter of a portion of the shoe plate 151, and a pair of side walls 153*b* which extend radially inwardly of the shoe plate 151 from either side of the respective bridging member 153*a*.

The bridging member 153*a* is arranged to support a brake pad 154 thereon, which faces radially outwardly of the shoe plate 151. Each brake shoe 153 is hingedly coupled at one end thereof to the shoe plate 151 via a pin 155 which extends between the side walls 153*b* through the plate 151. Each brake shoe 153 is hingedly coupled at the end of the shoe 153 which is the leading end of the shoe 153 as the plate 151 rotates within the drum 121 as the tether (not shown) is unwound from the spool 130.

The braking assembly 150 further comprises a plurality of elastic members 156, such as springs, for controlling the rotation of the brake shoes 153 about the respective hinge, namely the pin 155. The springs 156 are coupled at one end to a trailing end of one brake shoe 153 and at the other end to the trailing end of an adjacent brake shoe 153. In this respect, the springs 156 ensure that the brake shoes 153 pivot about the respective pin 155 only once a minimum rate of rotation of the plate 151 is reached. The braking assembly 150 further comprises a brake lining 157 which is disposed along an inner side of the drum 121. In this respect, the drum 121 and lining 157 effectively form a brake drum to which the brake shoes 153 can contact to retard the rotation of the plate 151.

The drive assembly 140 is coupled to the braking assembly 150 by a follower gear 160 which is rotationally coupled to the axle 152 of the braking assembly 150. The follower gear 160 is meshed with the drive gear 146 and as such the drive gear 146 and follower gear 160 are arranged to rotate together. Accordingly, in use, with the pulley 100 suitably anchored to a support (not shown) via the anchor member 116 and with a tether (not shown) wound upon the spool 130, a user desiring to exploit the self-braking facility of the pulley 100 would first secure the free end of the tether (not shown) to their harness (not shown) for example. With the pulley 100 in this rest condition, the pawl 143 is arranged in the neutral condition, whereby the proximal end 143*a* of the pawl 143 is held separated from the serrations 142 on the wheel 141 by virtue of the weight of the pawl 143 being displaced to the one side of the pivot 144 and the restoring force of the spring 145. However, as the user steps out from their position of height, the user will begin to fall and the tether (not shown) will begin to unwind from the spool 130 with an increasing rotational rate. As the rate of spool rotation increases, the pawl 143 will begin to rotate. The "heavy" distal end of the pawl 143 will rotate about the pivot 144 to a radially outer position of the spool 130 under the centrifugal force, thereby causing the proximal end 143*a* to rotate toward the serrations 142 on the wheel 141. As the rotational speed increases, a threshold will be reached whereby the proximal end 143*a* of the pawl 143 will locate with a short face 142*b* of a serration 142 on the wheel 141 and thus cause the wheel 141 to rotate with the spool 130, owing to the rotational coupling. At the same time, the drive gear 146 will be rotate which subsequently causes the follower gear 160 to rotate.

The driving of the follower gear 160 (and thus the axle 152 of the braking assembly 150), causes the shoe plate 151 to rotate within the brake drum 121. Accordingly, in a similar manner to the pawl 143, the brake shoes 153 pivot about the respective pin 155 under the centrifugal force created, thereby causing a leading edge of the brake pad 154 to contact the brake lining 157. As the rotational speed of the spool 130 and thus the shoe plate 151 increases, the brake shoes 153 will rotate further thereby bringing more surface area of the brake pad 154 into contact with the brake lining 157. This contact is arranged to limit the rotation of the spool 130 and thus the rate of extraction of the tether (not shown) therefrom to offer a controlled rate of decent of the user from their position of height.

It is to be appreciated that the ratchet formed within the drive assembly 140 only engages the braking assembly 150 when the spool 130 rotates in a particular direction. The spool 130 can thus be freely rotated in the opposite direction and as such in an alternative embodiment in which the free ends of the tether (not shown) extend out from the pulley 100, as opposed to one end of the tether being coupled to the spool 130, the pulley 100 can be used to lift a user or an item in a particular direction and control a rate of descent of the user or item in the opposite direction, owing to the rotational coupling of the tether to the spool 130 by the groove 131.

In yet a further embodiment, it is envisaged that the pulley 100 may comprise a separate drive assembly 140 and braking assembly 140 on opposite sides of the spool 130 for controlling the rate of rotation of the spool 130 in both rotational directions.

The invention claimed is:

1. A self-braking pulley for controlling a rate of extraction of a tether coupled with the pulley, the pulley comprising:

a spool for receiving a tether, the spool being arranged to rotate about an axle of the pulley as the tether is removed therefrom, a braking assembly comprising a shoe plate arranged to rotate with an axle, the shoe plate having a plurality of brake shoes pivotally coupled thereto for applying a braking force to the spool, and a drive assembly comprising a wheel having a plurality of serrations disposed along an outer perimeter thereof, a drive gear which is rotationally coupled with the wheel, the drive gear being arranged to drive the axle of the braking assembly, the drive assembly being engagable with the spool via a pawl which is pivotally coupled to the spool about a pivot, the drive assembly being arranged to drive the braking assembly, wherein the pawl is arranged to rotationally couple the spool with the drive assembly for driving the braking assembly, in dependence of a rate of rotation of the spool about the axle, and wherein during a rotation of the spool, a centrifugal force created by the rotation causes the pawl to pivot about the pivot to engage the drive assembly and also cause the brake shoes to pivot and apply a braking force to the spool to limit the rotation of the spool and the rate of extraction of the tether.

2. A self-braking pulley according to claim 1, wherein the wheel and drive gear are arranged to rotate about the axle.

3. A self-braking pulley according to claim 1, wherein the pawl is arranged to pivot in a plane in which the wheel extends.

4. A self-braking pulley according to claim 1, wherein the pawl comprises a center of mass which is disposed to one side of the pivot, such that a proximate end of the pawl extends closer to the pivot than a distal end of the pawl.

5. A self-braking pulley according to claim 4, wherein the pawl is reconfigurable between a neutral configuration in which the proximate end of the pawl extends away from the wheel, and a drive configuration in which the proximate end of the pawl abuts the serrations on the wheel.

6. A self-braking pulley according to claim 1, further comprising an elastic member which is coupled at one end to the spool and at the other end to a distal end of the pawl, for controlling the rotation of the pawl about the pivot.

7. A self-braking pulley according to claim 1, wherein the braking assembly comprises a plurality of brake pads which are arranged to contact a brake drum in dependence of a rate of rotation of the spool about the pulley axle.

8. A self-braking pulley according to claim 7, wherein the brake pads are separately disposed upon a respective shoe and each shoe is hingedly coupled to the shoe plate at angularly separated positions around a periphery of the plate.

9. A self-braking pulley according to claim 8, wherein the shoes are hingedly coupled at one end thereof to the plate, such that the contact area of the brake pad with the brake drum varies in dependence of a rate of rotation of the plate.

10. A self-braking pulley according to claim 1, wherein the shoes are hingedly coupled to the shoe plate at the one end of the shoe which is the leading end during rotation of the plate.

11. A self-braking pulley according to claim 1, wherein a trailing end of each shoe is coupled via an elastic member to the trailing end of the rotationally adjacent shoe.

12. A self-braking pulley according to claim 1, further comprising a housing for housing the spool, the drive assembly, the pawl and the braking assembly.

13. A self-braking pulley according to claim 12, wherein the pulley axle and the axle of the braking assembly are supported by the housing.

14. A self-braking pulley according to claim 1, further comprising at least one tether guide for guiding the tether to and from the spool.

* * * * *